US006114934A

United States Patent [19]

Ikeda et al.

[11] Patent Number: 6,114,934

[45] Date of Patent: Sep. 5, 2000

[54] VARIABLE LINEARITY COIL

[75] Inventors: Takeshi Ikeda; Masaharu Takebuchi; Takashi Tajima, all of Gunma-ken, Japan

[73] Assignee: Taiyo Yuden Kabushiki Kaisha, Tokyo, Japan

[21] Appl. No.: 09/193,727

[22] Filed: Nov. 17, 1998

[30] Foreign Application Priority Data

Dec. 19, 1997 [JP] Japan ..... 9-350634

[51] Int. Cl.[7] ..... H01F 27/00

[52] U.S. Cl. ..... 336/100; 315/400; 336/110; 336/185

[58] Field of Search ..... 336/110, 185, 336/155, 100; 335/257, 277, 210–213; 315/400

[56] References Cited

U.S. PATENT DOCUMENTS 2,918,639 12/1959 Beymer ..... 336/185
3,284,748 11/1966 Matsumoto ..... 336/233
4,713,589 12/1987 Kashiwagi ..... 315/400
5,374,912 12/1994 Houck, III ..... 335/132
5,473,299 12/1995 Tsutsumi et al. ..... 336/110

*Primary Examiner*—Michael L. Gellner
*Assistant Examiner*—Tuyen T. Nguyen
*Attorney, Agent, or Firm*—Arent Fox Kintner Plotkin & Kahn

[57] ABSTRACT

A variable linearity coil has a coil which is wound around a first core, a permanent magnet for charging a bias magnetic field to the first core, a bias magnetic field adjusting coil which is wound around a second core, and an electrically insulating base for mounting thereon the coil, the permanent magnet, and the magnetic field adjusting coil. The first core and the second core are placed one on top of the other with a non-magnetic and shock-absorbing spacer in between. Alternatively, the first core and the second core may be placed one on top of the other with a non-magnetic spacer in between, and a combination of the first core, the second core and the non-magnetic spacer is mounted on the base with a shock-absorbing spacer between the combination and the base.

10 Claims, 2 Drawing Sheets

VARIABLE LINEARITY COIL

BACKGROUND OF THE INVENTION

1. Field of the Invention

The present invention relates to a variable linearity coil which is used in a monitor of a personal computer, or the like.

2. Description of the Related Art

As is well known, the linearity coil is interposed for connection to a horizontal deflection circuit of a monitor of a television receiver set, personal computer, or the like for the purpose of correcting distortions on a monitor screen. In the television receiver set, or the like, the frequency of the electric current to flow or to be charged in the linearity coil is constant at 15.75 kHz or 33.75 kHz. Therefore, the correction of the distortions was possible with a linearity coil of a constant or predetermined DC (direct current) magnetic field. In the monitor of the personal computer, on the other hand, the range of the frequency of the electric current to be charged is as wide as 15 kHZ to 120 kHz. Therefore, there occurs a difference in the amount of correction between the time when the frequency is low and the time when the frequency is high. It follows that an appropriate correction of distortions cannot be made in a predetermined DC magnetic field.

As a solution, there has conventionally been proposed the following variable linearity coil as shown in FIG. 6. Namely, a magnetic core b which is made by winding therearound a coil "a" and a magnetic core d which is made by winding therearound a bias magnetic field adjusting coil c are placed one on top of the other in a vertical posture (i.e., with an axis of winding the coil extending in the up and down direction) together with a permanent magnet e. The sub-assembly thus obtained is placed on an electrically insulating base g which is made, for example, of a resin and which has embedded therein lead terminals f. The lead terminals f are connected to terminal ends of respective winding coils of the coil "a" and the bias magnetic field adjusting coil c.

In the above-described conventional variable linearity coil, when a sawtooth wave electric current is charged to the coil "a" which is interposed for connection to a horizontal deflection circuit of a cathode ray tube of a television set or the like, the magnetic core b will give rise to magnetostriction vibrations. The vibrations are then transmitted to a printed-circuit board via the base g, resulting in a resonance of the printed-circuit board. Consequently, beat notes are sometimes generated or, even if beat notes are not generated, the vibrations are transmitted to other component parts, resulting in a loss in their reliability. Further, since the magnetic coupling between the coil "a" and the bias magnetic field adjusting coil c is high, the sawtooth electric current in the coil "a" is induced to the bias magnetic field adjusting coil c. The sawtooth wave electric current thus flows in a manner overlapped with the DC bias control current of the bias magnetic field adjusting coil c. Therefore, a predetermined magnetic bias cannot be given to the core b. As a consequence, the original (or inherent) characteristics of the linearity coil cannot be obtained and the image on the cathode ray tube is thus disturbed.

In view of the above-described problems with the conventional variable linearity coil, the present invention has an object of providing a variable linearity coil: in which, when surface-mounted on a printed-circuit board, the occurrence of magnetostriction vibrations can be prevented; in which the reliability of other parts which are surface-mounted on the printed-circuit board is not impaired; and in which inherent characteristics of the linearity coil can be obtained to thereby cause no disturbances in the image on the screen of the cathode ray tube, or the like.

SUMMARY OF THE INVENTION

In order to attain the above and other objects, the present invention is a variable linearity coil comprising:

a coil which is wound around a first core; a permanent magnet for charging a bias magnetic field to the first core; a bias magnetic field adjusting coil which is wound around a second core; and an electrically insulating base for mounting thereon the coil, the permanent magnet, and the magnetic field adjusting coil, wherein the first core and the second core are placed one on top of the other with a non-magnetic and shock-absorbing spacer in between.

In another aspect of the present invention, there is provided a variable linearity coil comprising: a coil which is wound around a first core; a permanent magnet for charging a bias magnetic field to the first core; a magnetic field adjusting coil which is wound around a second core; and an electrically insulating base for mounting thereon the coil, the permanent magnet, and the magnetic field adjusting coil, wherein the first core and the second core are placed one on top of the other with a non-magnetic spacer in between, and wherein a combination of the first core, the second core and the non-magnetic spacer is mounted on the base with a shock-absorbing spacer between the combination and the base.

By interposing the non-magnetic and shock-absorbing spacer or the non-magnetic spacer between the coil and the bias magnetic field adjusting coil, the magnetic coupling between the coil and the bias magnetic field adjusting coil becomes smaller. Therefore, a predetermined magnetic bias can be charged to the first core around which the coil is wound. As a result, the inherent characteristics of the linearity coil can be obtained and, consequently, there will occur no disturbance in the image of the cathode ray tube.

Furthermore, since the non-magnetic and shock-absorbing spacer or the shock-absorbing spacer is interposed between the electrically insulating base and the coil, when the variable linearity coil is surface-mounted on the printed-circuit board, the printed-circuit board will not be subject to vibrations, whereby no beat note occurs. Still furthermore, since the printed-circuit board will not be vibrated, the reliability of other parts which are disposed close to the linearity coil is not impaired.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

Preferred embodiments of the present invention will now be explained with reference to the accompanying drawings.

Figure 1:
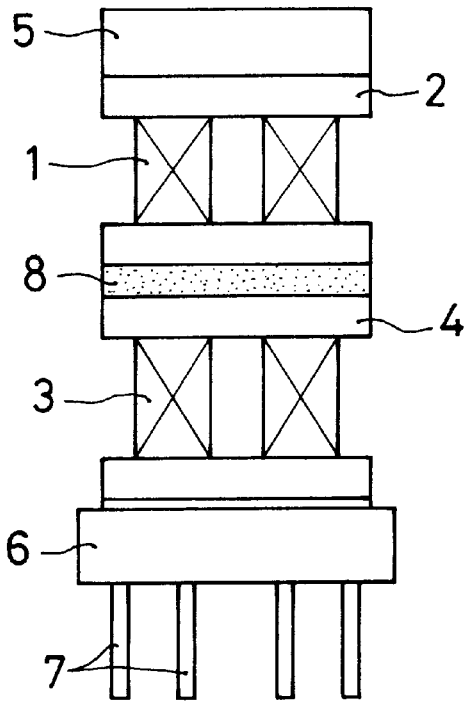
FIG. 1 is a sectional view of an important portion of a first example of the variable linearity coil according to the present invention.

FIG. 1 shows a first example of a variable linearity coil according to the present invention. In the figure, reference numeral 1 denotes a coil which is wound around a drum-shaped core 2 made of ferrite and which is interposed for connection to a horizontal deflection circuit of a cathode ray tube. Reference numeral 3 denotes a bias magnetic field adjusting coil which is wound around a drum-shaped core 4 made of ferrite. Reference numeral 5 denotes a disc-shaped permanent magnet which is adhered to an outer surface of a flange on an upper portion of the drum-shaped core 2. Reference numeral 6 denotes an electrically insulating base which is made of a resin or the like and on which are fixedly placed the coil 1, the bias magnetic field adjusting coil 3, and the permanent magnet 5. The base 6 has lead terminals 7 around which terminal ends of the coil 1 and of the bias magnetic field adjusting coil 3 are wound and soldered.

The above-described constituting elements are not different from those of a conventional linearity coil.

In the present invention, between the drum-shaped core 2 and the drum-shaped core 4, there is interposed a spacer 8 which is made of a nonmagnetic material such as a spongy resin, rubber, or the like and which also serves as a shock-absorbing material. The spacer 8 is adhered to both the cores 2, 4. The thickness of this spacer 8 is set to a value which satisfies the following conditions: i.e., that the magnetostriction vibrations of the drum-shaped core 2 is absorbed; that the direct current (DC) bias control current and the sawtooth wave electric current do not flow in a manner overlapped with each other due to magnetic coupling between the coil 1 and the bias magnetic field adjusting coil 3; and that the drum-shaped core 2 can be charged with a predetermined direct current magnetic bias. According to the above-described arrangement, even if the magnetostriction vibrations of the drum-shaped core 2 may occur to the drum-shaped core 2 due to the horizontal deflection current which flows in the coil 1, these vibrations will be absorbed by the spacer 8. Therefore, the vibrations will not be transmitted to the base 6 and, as a consequence, beat notes due to vibrations of the printed-circuit board will not occur. Further, by the DC current of a predetermined value which flows in the bias magnetic field adjusting coil 3, a predetermined DC magnetic bias is given to the drum-shaped core 2, whereby the inherent characteristics of the linearity coil can be obtained.

Examples of dimensions of respective parts are as follows. The drum-shaped core 2 is made up of: the coil 1 formed by bundling together 20 insulation-coated wires each having a diameter of 0.2 mm and by winding them 25 turns; a column-shaped portion of 6 mm in diameter; and circular flanges each having a diameter of 15 mm, the total height of the core being 13 mm. The drum-shaped core 4 is made up of: the bias magnetic field adjusting coil 3 formed by winding 500 turns of an insulation-coated wire of 0.2 mm in diameter; a column-shaped portion of 6.5 mm in diameter; and circular flanges each having a diameter of 15 mm, the total height of the core 4 being 3 mm. The permanent magnet 5 is of a. disc shape with a diameter of 14 mm and a height of 3 mm. The spacer 8 is 2 mm in thickness and 14.5 mm in diameter and is made of urethane foam which is both nonmagnetic and shock-absorbing.

The above-described linearity coil is disposed on a printed-circuit board and the lead terminals 7 are fixed to the wiring portion by means of soldering. A sawtooth wave electric current of 12A with a peak value of $I_{PP}$ at a frequency of 64 kHz is caused to flow through the coil 1. The vibration level of the printed-circuit board was measured with a vibration sensor which is attached thereto. The output of the vibration sensor was amplified by an amplifier, and a voltage value was measured by a level meter. The vibration level confirmed by this voltage value was found to be 0.05 mV. When the linearity coil was actually surface-mounted on the printed-circuit board, there occurred no beat notes.

Figure 2A:
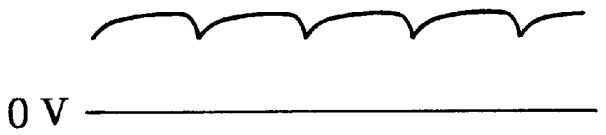
FIGS. 2A and 2B are graphs of waveforms of an electric current to flow through the magnetic field adjusting coil of the linearity coil shown in FIG. 1 and that to flow through the magnetic field adjusting coil of a conventional linearity coil, respectively.

This linearity coil has a magnetic coupling coefficient of 0.1 between the coil 1 and the bias magnetic field adjusting coil 3. A wave form is shown in FIG. 2A when a sawtooth wave electric current of 12A with a peak value of $I_{PP}$ at a frequency of 64 kHz was caused to flow through the coil 1 and a DC current of 200 mA was caused to flow through the bias magnetic field adjusting coil 3. As can be seen from this graph, there is little or no effect of the sawtooth wave electric current to flow through the coil 1. When this linearity coil was used, there occurred no disturbances in the image on a cathode ray tube.

Figure 6:
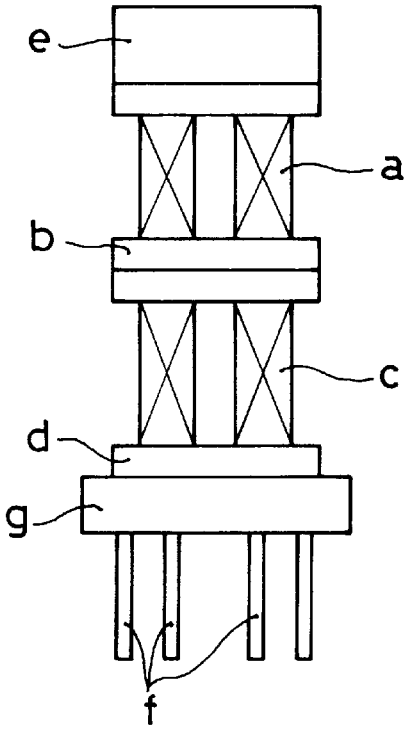
FIG. 6 PRIOR ART
FIG. 6 is a sectional view of an important portion of a conventional variable linearity coil.

Comparative Example (as shown in FIG. 6)

Regarding the following elements, the same elements as those in the example shown in FIG. 1 were used. Namely, the magnetic cores b and d, the disc-shaped permanent magnet e, the coil "a" which is wound around one "b" of the magnetic cores, the bias magnetic field adjusting coil c which is wound around the other magnetic core d, and the base g into which 4 lead terminals f are embedded, were the same as those in the example shown in FIG. 1.

This variable linearity coil was mounted on a printed-circuit board and the lead terminals were fixed by soldering to the wiring portion. A sawtooth wave electric current of 12A with a peak value of $I_{PP}$ at a frequency of 64 kHz was caused to flow through the coil "a" and the vibration level of the printed-circuit board that was confirmed by the voltage value of the level meter, in the same manner as described above, was found to be 0.5 mV. There occurred beat notes in the printed-circuit board.

Figure 2B:
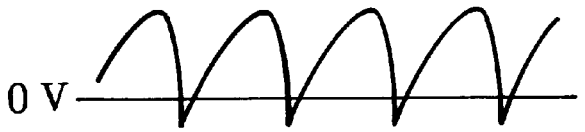

The magnetic coupling coefficient k between the coil "a" and the bias magnetic field adjusting coil c was 0.5. A wave form is shown in FIG. 2B when a sawtooth wave electric current of 12A with a peak value of $I_{PP}$ at a frequency of 64 kHz was caused to flow through the coil "a" and a DC current of 200 mA was caused to flow through the bias magnetic field adjusting coil 3. In this case, under the influence of the sawtooth wave electric current to flow through the coil "a", there occurred a disturbance in the image of the cathode ray tube.

As is well known, the magnetic coupling coefficient k can be obtained by the following formula.

$$k=M/(L_1 \cdot L_2)^{1/2}$$

where M is a mutual inductance and can be shown as M=(La −Lo)/4 (where La is an inductance when the coil 1 and the bias magnetic field adjusting coil 3 are connected in series, and Lo is an inductance when the above two coils are connected in series by inverting one of them), and $L_1$ and $L_2$ are inductances of the coil 1 and the bias magnetic field adjusting coil 3, respectively.

Figure 3:
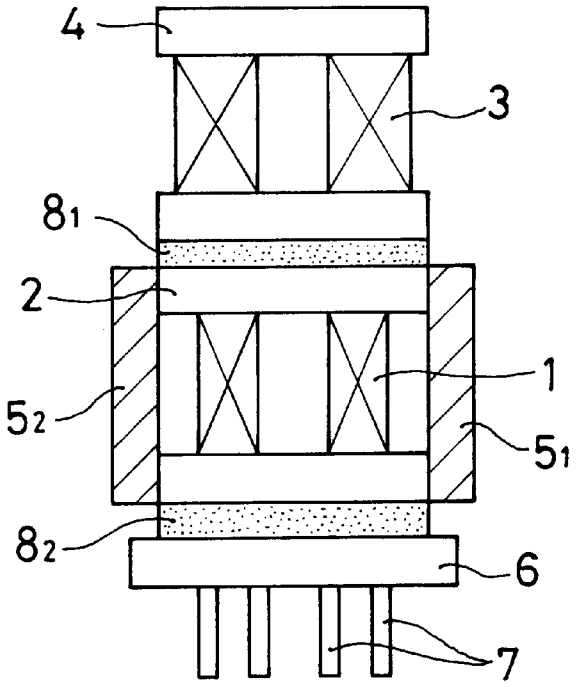
FIG. 3 is a sectional view of an important portion of a second example of the variable linearity coil according to the present invention.

FIG. 3 shows a second example of the variable linearity coil of the present invention.

In this example, on top of a drum-shaped core 2 around which a coil 1 is wound, there is placed a drum-shaped core 4 around which a bias magnetic field adjusting coil 3 is wound. The drum-shaped core 4 is placed via a spacer $\mathbf{8}_1$ which is made of a non-magnetic material. The above-mentioned combination (or sub-assembly) of the core 2, the core 4, and the spacer $\mathbf{8}_1$ is fixedly mounted on a base 6, which is provided with lead terminals 7, via a spacer $\mathbf{8}_2$ which is made of a shock-absorbing material. Two permanent magnets of substantially C-shape $\mathbf{5}_1$, $\mathbf{5}_2$ combined into a cylindrical shape are disposed around the periphery of the drum-shaped core 2.

The spacer $\mathbf{8}_1$ was made of phenol resin of 0.3 mm thick, and the spacer $\mathbf{8}_2$ was made of butyl rubber sheet of 1.0 mm thick. Setting was made of the degree of magnetic coupling between the coil 1 and the bias magnetic field adjusting coil 3 by means of the spacer $\mathbf{8}_1$, and the magnetostriction vibrations of the drum-shaped core 2 are absorbed by the spacer $\mathbf{8}_2$. The magnetic coupling coefficient k was 0.2 and the voltage which shows the vibration of the printed-circuit board was 0.06 mV.

In this second example, the same dimensions as those shown in FIG. 1 were used for the following elements, i.e., the drum-shaped core 2 around which the coil 1 is wound, the drum-shaped core 4 around which the bias magnetic field adjusting coil 3 is wound, and the base 6 on which the lead terminals 7 are provided. As the C-shaped permanent magnets $\mathbf{5}_1$, $\mathbf{5}_2$, there were used those having dimensions of an as-coupled inner diameter of 7.6 mm, an outer diameter of 11.6 mm, and a height of 13 mm.

Figure 4:
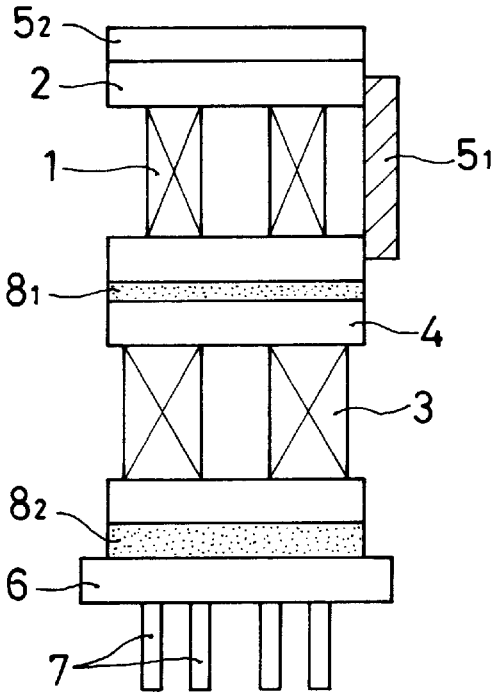
FIG. 4 is a sectional view of an important portion of a third example of the variable linearity coil according to the present invention.

FIG. 4 shows a third example of the variable linearity coil of the present invention.

The difference of this third example from the second example shown in FIG. 3 is as follows. Namely, the positional relationship as seen in the vertical direction between the drum-shaped core 2 around which the coil 1 is wound and the drum-shaped core 4 around which the bias magnetic field adjusting coil 3 is wound was reversed relative to the base 6. Further, as the permanent magnets, there are used a C-shaped permanent magnet $\mathbf{5}_1$ which is disposed in the periphery of the drum-shaped core 2 and a disc-shaped permanent magnet $\mathbf{5}_2$ which is disposed on an outer surface of that flange of the drum-shaped core 1 which lies on an upper side.

As the non-magnetic spacer $\mathbf{8}_1$ which is interposed between the drum-shaped core 2 and the drum-shaped core 4, an acrylic resin sheet (or plate) of 0.5 mm thick was used. As the shock-absorbing spacer $\mathbf{8}_2$ which is interposed between the drum-shaped core 4 and the base 6, a silicone rubber sheet (or plate) of 2 mm thick was used. The magnetic coupling coefficient k of this example was 0.15 and the voltage which shows the vibrations of the printed-circuit board was 0.05 mV.

In this example, there were used the C-shaped permanent magnet $\mathbf{5}_1$ of 13 mm high, and the disc-shaped permanent magnet $\mathbf{5}_2$ of 14 mm in diameter and 2.4 mm thick. The remaining constituting elements are the same as those used in the second example shown in FIG. 3.

Figure 5:
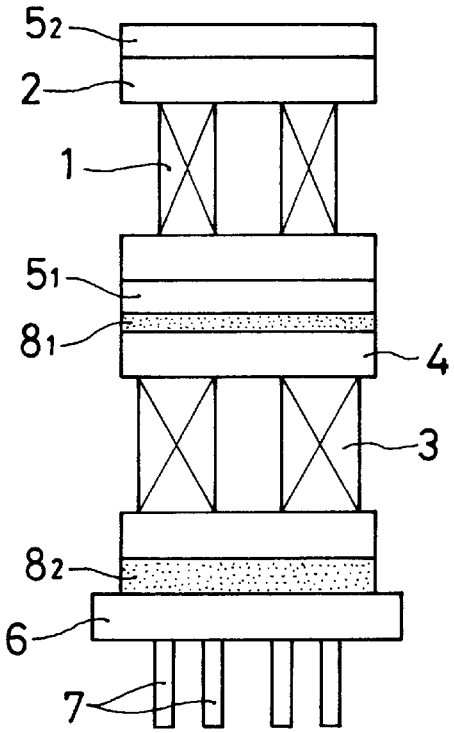
FIG. 5 is a sectional view of an important portion of a modified example of the variable linearity coil shown in FIG. 4.

FIG. 5 shows a modified example of linearity coil which is shown in FIG. 5. The difference between this modified example and the third example in FIG. 5 is that two disc-shaped permanent magnets $\mathbf{5}_1$, $\mathbf{5}_2$ are disposed on the outer surfaces of the upper and lower flanges, respectively, of the drum-shaped core 2. The magnetic coupling coefficient k of this modified example was 0.1 and the voltage which shows the vibrations of the printed-circuit board was 0.05 mV.

In this modified example, permanent magnets $\mathbf{5}_1$, $\mathbf{5}_2$ of 14 mm in diameter and 15 mm thick were used. The remaining constituting elements are the same as those in the example shown in FIG. 4.

It has been found that the magnetic coupling coefficient k between the coil 1 and the bias magnetic field adjusting coil 3 shall preferably be 0.1 through 0.2 in view of the results of experiments with the above-described and other examples.

Though not illustrated in the above-described examples, the variable linearity coil is provided with an external covering either by providing a resin coating by means of dip coating, or by containing the linearity coil in a resin casing, or by covering the linearity coil with a resin tube.

As explained hereinabove, according to the present invention, the occurrence of beat notes can be prevented when the variable linearity coil is mounted on the printed-circuit board. As a result, the reliability of other parts which are surface-mounted on the printed-circuit board is not impaired. Still furthermore, the inherent characteristics of the linearity coil can be obtained, whereby the disturbance of the image on the cathode ray tube is prevented.

It is readily apparent that the above-described variable linearity coil meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A variable linearity coil comprising:

a coil which is wound around a first core;

a permanent magnet for charging a bias magnetic field to said first core;

a bias magnetic field adjusting coil which is wound around a second core; and an electrically insulating base for mounting thereon said coil, said permanent magnet, and said magnetic field adjusting coil, wherein said first core and said second core are placed one on top of the other with a non-magnetic and shock-absorbing spacer in between.

2. A variable linearity coil comprising:

a coil which is wound around a first core;

a permanent magnet for charging a bias magnetic field to said first core;

a magnetic field adjusting coil which is wound around a second core; and an electrically insulating base for mounting thereon said coil, said permanent magnet, and said magnetic field adjusting coil, wherein said first core and said second core are placed one on top of the other with a non-magnetic spacer in between, and wherein a combination of said first core, said second core and said non-magnetic spacer is mounted on said base with a shock-absorbing spacer between said combination and said base.

3. The variable linearity coil of claim 1, wherein said shock-absorbing spacer is made of a spongy resin.

4. The variable linearity coil of claim 1, wherein said shock-absorbing spacer is made of rubber.

5. The variable linearity coil of claim 1, wherein said shock-absorbing spacer is made of phenol resin.

6. The variable linearity coil of claim 1, wherein said shock-absorbing spacer is made of butyl rubber.

7. The variable linearity coil of claim 2, wherein said shock-absorbing spacer is made of a spongy resin.

8. The variable linearity coil of claim 2, wherein said shock-absorbing spacer is made of rubber.

9. The variable linearity coil of claim 2, wherein said shock-absorbing spacer is made of phenol resin.

10. The variable linearity coil of claim 2, wherein said shock-absorbing spacer is made of butyl rubber.

* * * * *